US012270594B2

(12) United States Patent
Kim et al.

(10) Patent No.: US 12,270,594 B2
(45) Date of Patent: Apr. 8, 2025

(54) REFRIGERATOR

(71) Applicant: LG ELECTRONICS INC., Seoul (KR)

(72) Inventors: Kyeonghun Kim, Seoul (KR); Seok Heo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 186 days.

(21) Appl. No.: 17/968,216

(22) Filed: Oct. 18, 2022

(65) Prior Publication Data

US 2024/0125539 A1 Apr. 18, 2024

(30) Foreign Application Priority Data

Oct. 13, 2022 (KR) ..... 10-2022-0131422

(51) Int. Cl.
*F25D 23/02* (2006.01)
*A47F 3/04* (2006.01)
(Continued)

(52) U.S. Cl.
CPC ..... *F25D 23/028* (2013.01); *F25D 21/04* (2013.01); *F25D 23/066* (2013.01);
(Continued)

(58) Field of Classification Search
CPC .. F25D 23/028; F25D 23/066; F25D 2201/10; F25D 2400/02; F25D 2400/36;
(Continued)

(56) References Cited

U.S. PATENT DOCUMENTS 10,704,826 B2 7/2020 Lee et al.
10,767,917 B2 * 9/2020 Kim ..... A47F 3/0434
(Continued)

FOREIGN PATENT DOCUMENTS

KR 20190098119 * 8/2019
KR 10-2273092 7/2021

*Primary Examiner* — Kimberley S Wright
(74) *Attorney, Agent, or Firm* — KED & ASSOCIATES, LLP

(57) ABSTRACT

The present disclosure relates a refrigerator including cabinet forming a storage space; and a door configured to open and close the storage space; in which the door includes an outer plate forming a front surface of the door and having an opening; a panel assembly mounted to the opening; a door liner forming a rear surface of the door; and a support frame configured to support a rear surface of the panel assembly; in which the panel assembly includes a front panel forming a front surface; an adiabatic panel disposed at the rear spaced apart from the front panel; a rear panel forming a rear surface; and an interstitial rod disposed between the front panel and the adiabatic panel, and in which the support frame includes a panel support portion formed along the circumference of the front panel; a heater accommodation groove recessed from a front surface to a rear surface of the panel support portion to accommodate a heater configured to heat the front panel; and a heater restraint portion protruding from one surface of the heater accommodation groove to be in contact with at least a portion of the heater.

15 Claims, 13 Drawing Sheets

(51) Int. Cl.
*F25D 21/04* (2006.01)
*F25D 23/06* (2006.01)

(52) U.S. Cl.
CPC .... *F25D 2201/10* (2013.01); *F25D 2323/023* (2013.01); *F25D 2400/02* (2013.01); *F25D 2400/36* (2013.01)

(58) Field of Classification Search
CPC .... F25D 23/02; F25D 21/04; F25D 2323/023; A47F 3/0434
See application file for complete search history.

(56) References Cited

U.S. PATENT DOCUMENTS

| | | | | |
|---|---|---|---|---|
| 10,941,982 | B2 * | 3/2021 | Lee | G06F 3/044 |
| 11,821,676 | B2 * | 11/2023 | Son | F25D 23/028 |
| 11,846,464 | B2 * | 12/2023 | Kim | F25D 27/00 |
| 11,859,901 | B2 * | 1/2024 | Kang | F25D 27/005 |
| 2018/0164031 | A1 * | 6/2018 | Lee | F25D 11/00 |
| 2018/0189027 | A1 * | 7/2018 | Jeon | F25D 23/02 |
| 2018/0274846 | A1 * | 9/2018 | Kim | F25D 27/005 |
| 2018/0274852 | A1 * | 9/2018 | Kang | F25D 27/005 |
| 2018/0310726 | A1 * | 11/2018 | Oh | A47F 3/0434 |
| 2019/0249485 | A1 * | 8/2019 | Jeong | E06B 3/6722 |
| 2019/0360745 | A1 * | 11/2019 | Lee | F21V 33/0044 |
| 2019/0383551 | A1 * | 12/2019 | Choi | F25D 23/028 |
| 2020/0271373 | A1 * | 8/2020 | Choe | F25D 23/061 |
| 2020/0363121 | A1 * | 11/2020 | Kim | A47F 3/0434 |
| 2024/0068735 | A1 * | 2/2024 | Kim | F25D 23/02 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2022-0131422 (Oct. 13, 2022), which is hereby incorporated by reference in its entirety.

THE BACKGROUND

1. The Field

The present disclosure relates to a refrigerator.

2. Description of the Related Art

In general, a refrigerator is a home appliance that allows food to be stored at a low temperature in an internal storage space that is opened and closed by a door. To this end, the refrigerator is configured so that the stored food can be stored in an optimal state by cooling the inside of the storage space using cold air generated through heat exchange with a refrigerant circulating in the refrigeration cycle.

Recent refrigerators are gradually becoming larger and more multifunctional in accordance with changes in dietary habits and the trend of luxury products, and a refrigerator having various structures and convenient devices for user convenience and efficient use of internal space thereof has been released.

Recently, Korean Registered Patent No. 10-2273092 discloses a refrigerator in which a portion of the door is made transparent or the inside of the refrigerator can be seen, so that food inside the refrigerator can be checked without opening the door.

THE SUMMARY

An object of an embodiment of the present disclosure is to provide a refrigerator in which at least a portion of a refrigerator door can be selectively made transparent by a user's manipulation so that the inside of the refrigerator can be seen through in a state where the refrigerator door is closed.

An object of an embodiment of the present disclosure is to provide a refrigerator capable of preventing dew condensation from being generated on a front panel forming a front surface of a door.

An object of an embodiment of the present disclosure is to provide a refrigerator in which assembling and mounting of a heater for preventing dew condensation is easy.

A refrigerator according to an embodiment of the present disclosure includes a cabinet forming a storage space; and a door configured to open and close the storage space; in which the door includes an outer plate forming a front surface of the door and having an opening; a panel assembly mounted to the opening; a door liner forming a rear surface of the door; and a support frame configured to support a rear surface of the panel assembly; in which the panel assembly includes a front panel forming a front surface; an adiabatic panel disposed at the rear spaced apart from the front panel; a rear panel forming a rear surface; and an interstitial rod disposed between the front panel and the adiabatic panel, and in which the support frame includes a panel support portion formed along the circumference of the front panel; a heater accommodation groove recessed from a front surface to a rear surface of the panel support portion to accommodate a heater configured to heat the front panel; and a heater restraint portion protruding from one surface of the heater accommodation groove to be in contact with at least a portion of the heater.

The front panel may be formed larger than the adiabatic panel or the rear panel, and the heater accommodation groove may be formed along a circumference of the front panel.

A plurality of the heater restraint portions may be arranged along the heater accommodation groove.

The heater accommodation groove may include a first portion formed on one end of the panel support portion; a second portion spaced apart from the first portion in one direction; and a third portion configured to connect a rear end of the first portion and a rear end of the second portion.

The heater may be disposed to be spaced apart from the third portion by a set interval.

The heater restraint portion may be formed to protrude from the second portion toward the first portion.

The end portion of the second portion may be formed to extend further forward than the front end of the panel support portion, and the heater accommodation groove may include a round groove formed by being recessed to be rounded from the second portion.

The heater may be in contact with the round groove.

The outer plate may include a plate bent portion bent backward on a circumferential surface of the opening, and the support frame may include a plate accommodation groove formed at the other end of the panel support portion and formed so that the plate bent portion is inserted thereinto.

A length recessed from the front to the rear of the heater accommodation groove may be formed to correspond to a length in which the plate accommodation groove is recessed from the front to the rear.

A length recessed from the front to the rear of the heater accommodation groove may be formed to be twice or more the diameter of the heater.

The door may include a main door configured to open and close the storage space; and a sub door rotatably connected to the main door; and the sub door may be formed by coupling the outer plate, the panel assembly, the door liner, and the support frame.

A bezel may be formed along the circumference of the front panel, and the heater may be disposed at a position corresponding to the bezel.

A refrigerator according to an embodiment of the present disclosure includes a cabinet forming a storage space; and a door configured to open and close the storage space; in which the door includes a main door configured to open and close the storage space; and a sub door rotatably connected to the main door; in which the sub door includes an outer plate forming a front surface of the door and having an opening; a panel assembly mounted to the opening; a door liner forming a rear surface of the door; and a support frame configured to support a rear surface of the panel assembly; and in which the support frame includes a panel support portion formed along a circumference of the panel assembly; a heater accommodation groove recessed from the front to the rear of the panel support portion to receive a heater configured to heat the panel assembly; and a heater restraint portion configured to protrude from one surface of the heater accommodation groove to be in contact with at least a portion of the heater.

The panel assembly may include a front panel forming a front surface; an adiabatic panel disposed at the rear spaced apart from the front panel; a rear panel forming a rear surface; and an interstitial rod disposed between the front panel and the adiabatic panel, in which the front panel may be formed to be larger than the adiabatic panel and the rear panel, and the heater may be disposed along a circumference of a rear surface of the front panel.

In the refrigerator according to the proposed embodiment, the following effects can be expected.

In the refrigerator according to the embodiment of the present disclosure, the inside of the refrigerator can be selectively visualized by selectively change the see-through portion of the panel assembly to be the transparent state or the opaque state.

In the refrigerator according to an embodiment of the present disclosure, a support frame is provided inside the door, and the outer plate and the panel assembly can be supported by the support frame. In addition, the support frame may be disposed such that the heater is in contact with the front panel, which has poor adiabatic properties, to prevent dew condensation from being generated on the front panel.

In addition, since the support frame is provided with a heater restraint portion for fixing the heater, there is an advantage in that the operation of mounting the heater to the support frame is simplified.

THE DETAILED DESCRIPTION

Hereinafter, specific embodiments of the present disclosure will be described in detail with drawings. However, the present disclosure cannot be said to be limited to the embodiments in which the spirit of the present disclosure is presented, and other disclosures that are degenerate by addition, changes, deletions, or the like of other elements or other embodiments included within the scope of the present disclosure can be easily suggested.

Before the description, directions are defined. According to an embodiment of the present disclosure, the direction toward the door may be defined as the front direction with respect to the cabinet illustrated in FIG. 1, the direction toward the cabinet with respect to the door may be defined as the rear direction, the direction toward the floor where the refrigerator is installed may be defined as the downward direction, and the direction which is away from the floor may be defined as the upward direction.

Figure 1:
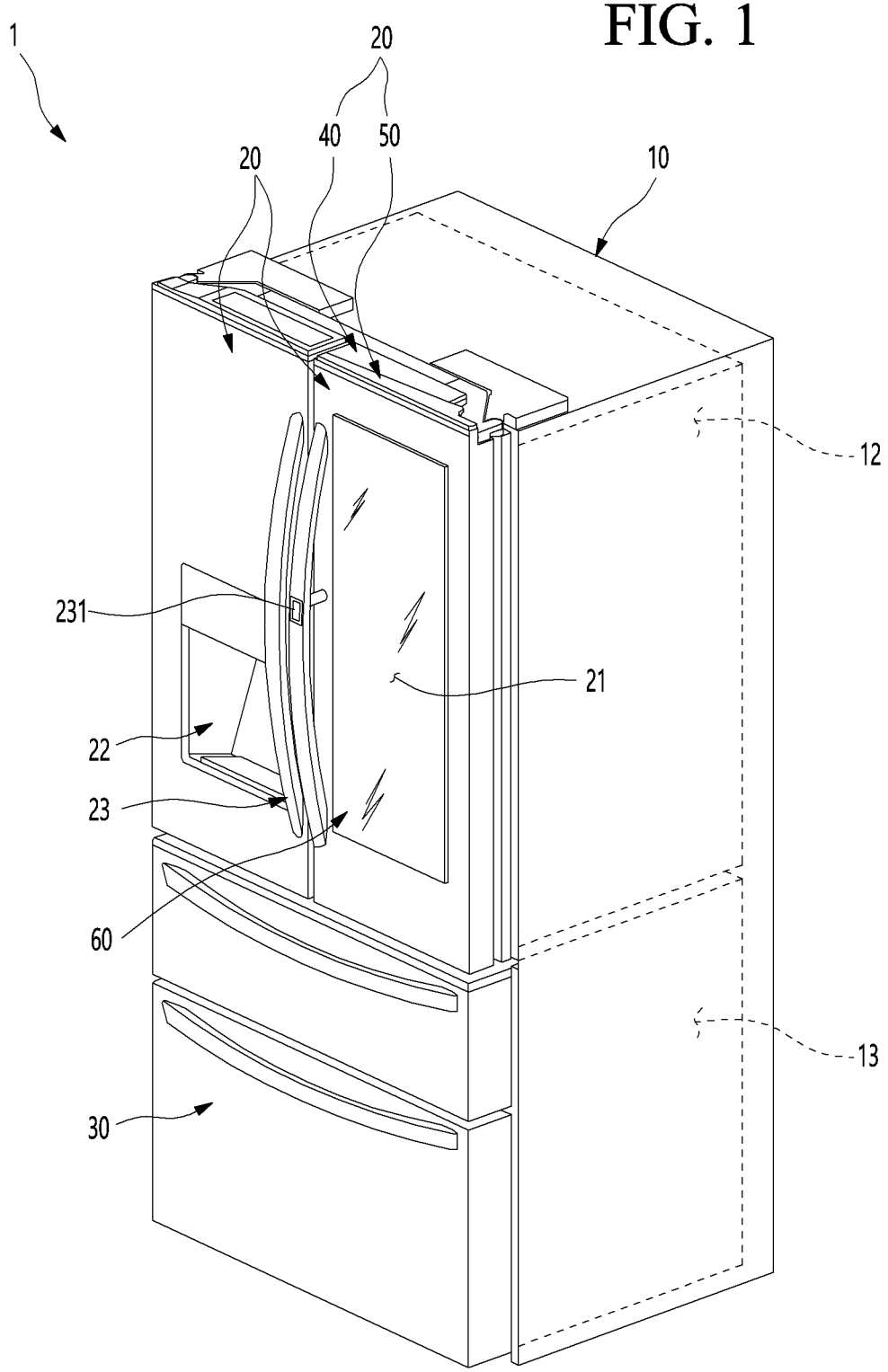
FIG. 1 is a perspective view illustrating a refrigerator according to an embodiment of the present disclosure.

In addition, an embodiment of the present disclosure may define a left direction and a right direction based on a view of the refrigerator from the front with reference to FIG. 1.

FIG. 1 is a perspective view illustrating a refrigerator according to an embodiment of the present disclosure.

The refrigerator 1 according to an embodiment of the present disclosure may be formed by a cabinet 10 forming a storage space and doors 20 and 30 opening and closing the storage space.

The cabinet 10 may be partitioned vertically by a barrier 11. A refrigerating chamber 12 may be formed at an upper portion of the cabinet 10, and a freezing chamber 13 may be formed at a lower portion of the cabinet 10.

A controller 14 for controlling the overall operation of the refrigerator 1 may be formed on the upper surface of the cabinet 10. The controller 14 may be configured to control not only the cooling operation of the refrigerator 1, but also the electronic components for the selective viewing and screen output of the see-through portion 21.

The door may include the refrigerating chamber door 20 and the freezing chamber door 30. The refrigerating chamber door 20 may be opened and closed by rotating the opened front surface of the refrigerating chamber 12. The freezing chamber door 30 may be opened and closed by rotating the opened bottom surface of the freezing chamber 13.

A pair of refrigerating chamber doors 20 may be provided in the left and right direction so that the refrigerating chamber 12 may be configured to be shielded by the pair of refrigerating chamber doors. A pair of freezing chamber doors 30 may be provided in the left and right direction and the freezing chamber 13 may be configured to be opened and closed by the pair of freezing chamber doors. Alternatively, the freezing chamber door 30 may be configured to be withdrawable in a drawer type as needed and may be configured as one or more.

In the embodiment of the present disclosure, a refrigerator to which a French-type door that opens and closes by rotating a pair of doors in one space is applied to a bottom-freeze-type refrigerator having a freezing chamber 13 provided below is described as an example, but the present disclosure may be applied to any type of refrigerator provided with a door regardless of the shape of the refrigerator of the present disclosure.

The refrigerating chamber door 20 and the freezing chamber door 30 form the overall outer appearance when viewed from the front, and the outer appearance thereof is formed of a metal material, so that the entire refrigerator 1 has a texture of a metal material. In addition, if necessary, the refrigerating chamber door 20 may be provided with a dispenser 22 for extracting water or ice.

In addition, a handle 23 may be formed on the refrigerating chamber door 20 and the freezing chamber door 30. A user can open and close the refrigerating chamber door 20 or the freezing chamber door 30 by putting a user's hand in the handle 23.

A manipulation button 231 is provided on the handle 23, and a locking unit 232 operated by the manipulation button 231 is provided on the sub door 50. The locking unit 232 protrudes to the rear of the sub door 50 and may be selectively separated from the restraint member 404 of the main door.

Meanwhile, at least one side of the door may be formed to allow a see-through inside the refrigerator. The refrigerating chamber door 20 may be provided with a see-through portion 21 that is a region through which a storage space and/or a space inside the refrigerator of the rear surface of the door can be seen through.

The see-through portion 21 may constitute at least a portion of the front surface of the refrigerating chamber door 20. The see-through portion 21 may be selectively transparent or opaque according to a user's manipulation. The user can identify the food stored in the refrigerator through the see-through portion 21.

Although the embodiment of the present disclosure has been described as an example that the see-through portion 21 is formed on the refrigerating chamber door 20, the see-through portion 21 may be provided in various other types of refrigerator doors including the freezing chamber door 30 according to the structure and shape of the refrigerator.

Figure 2:
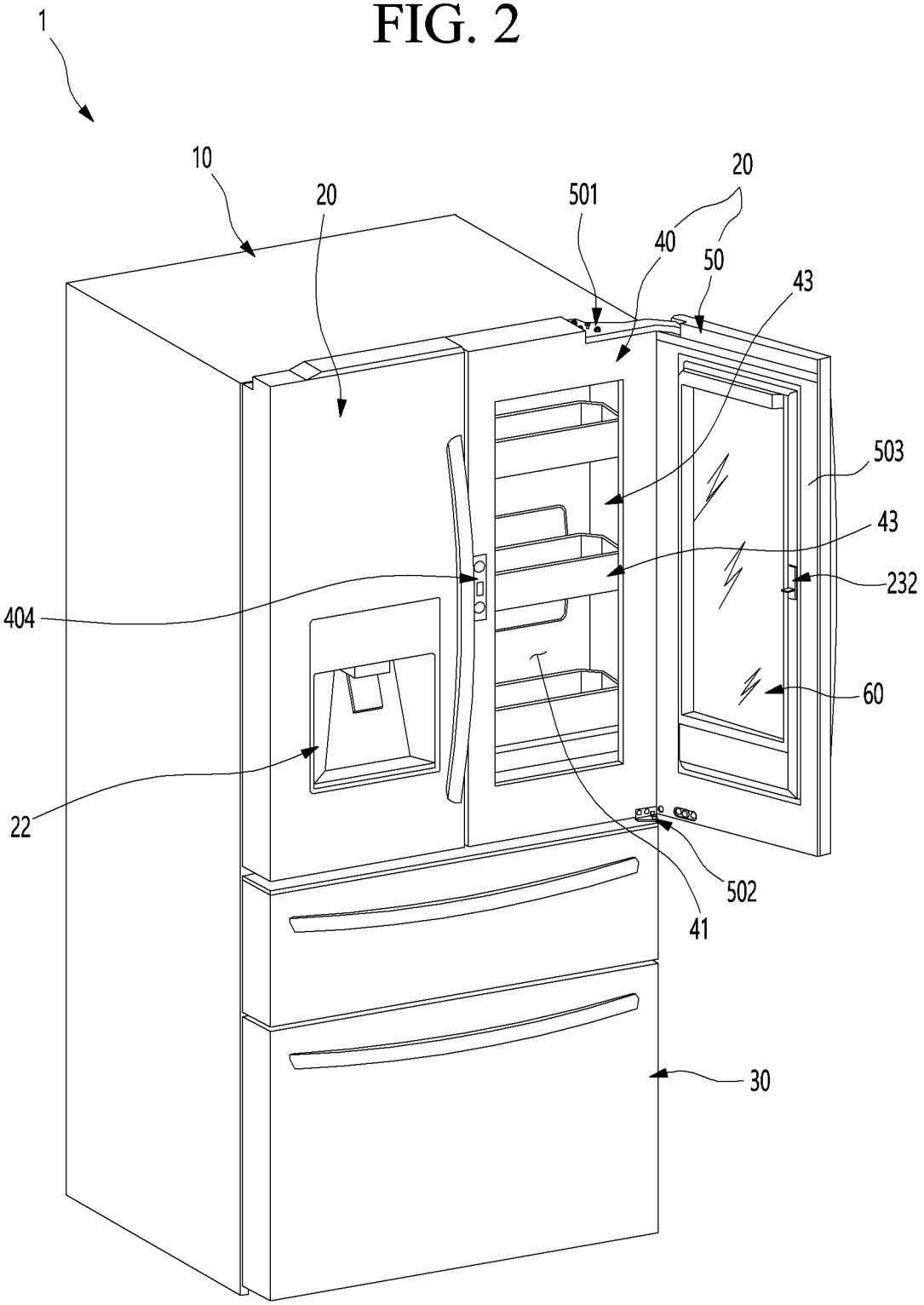
FIG. 2 is a perspective view illustrating a state where a sub door of the refrigerator is opened.
Figure 3:
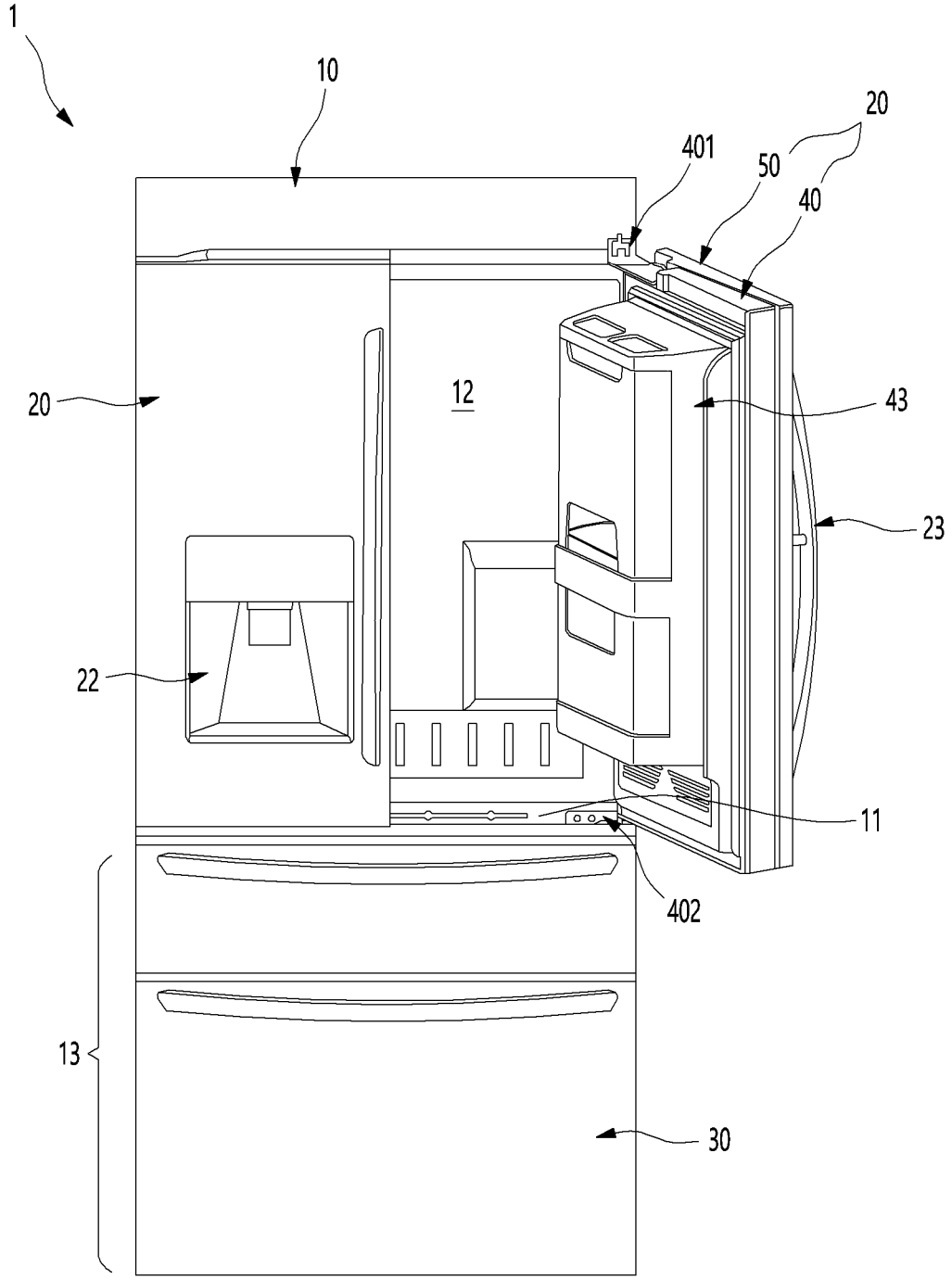
FIG. 3 is a perspective view illustrating a state where the main door of the refrigerator is opened.

FIG. 2 is a perspective view illustrating a state where a sub door of the refrigerator is opened, and FIG. 3 is a perspective view illustrating a state where the main door of the refrigerator is opened.

Referring to FIG. 2, the right side refrigerating chamber door 20 among the pair of refrigerating chamber doors 20 may be configured to open and close double. The refrigerating chamber door 20 located on the right side includes the main door 40 for opening and closing the refrigerating chamber 12, and the sub door 50, which is rotatably disposed on the main door 40 to open and close the opening 41 formed in the main door 40.

The main door 40 may be formed to have the same size as the refrigerating chamber door 20 on the left side (as seen in FIG. 1) among the pair of refrigerating chamber doors 20. The main door 40 is rotatably mounted by the cabinet 10 by the upper hinge 401 and the lower hinge 402 to open and close at least a portion of the refrigerating chamber 12.

An opening 41 is formed in the main door 40 to have a predetermined size. A door basket 431 may be mounted on the rear surface of the main door 40. In this case, the size of the opening 41 may be formed to occupy most of the front surface of the main door 40 except for a portion of the circumference of the main door 40.

A main gasket 45 is provided around the rear surface of the main door 40 to prevent cold air from leaking in the inner space of the cabinet 10 when the main door 40 is opened and closed.

The sub door 50 is rotatably mounted on the front surface of the main door 40 to open and close the opening 41. Accordingly, the opening 41 may be exposed through the opening of the sub door 50.

The size of the sub door 50 may be the same as the size of the main door 40 to shield the entire front surface of the main door 40.

In a state where the sub door 50 is closed, the main door 40 and the sub door 50 are coupled to each other and may be configured to have the same size and shape as the refrigerating chamber door 20 formed on the side.

A sub gasket 503 is provided on the rear surface of the sub door 50 to seal between the main door 40 and the sub door 50.

The sub door 50 is provided with a panel assembly 60 in the center. The panel assembly 60 may optionally be provided so as to be able to see through the inside of the refrigerator. Such a panel assembly 60 may also be referred to as a transparent panel assembly 60.

Even when the sub door 50 is closed by the panel assembly 60, the inside of the opening 41 can be selectively seen through.

The see-through portion 21 may be defined as a portion in which the inner side of the refrigerator is visible on the sub door 50. However, the see-through portion 21 may not coincide with the entire panel assembly 60.

The panel assembly 60 may be configured to selectively change a transparent or opaque state according to a user's manipulation. Accordingly, it becomes transparent only in a state of being desired by the user to visualize the inside of the chamber, and in other states, it is possible to maintain an opaque state. The panel assembly 60 may also output a screen in a transparent or opaque state.

In the embodiment of the present disclosure, the panel assembly 60 is configured to shield the opened portion of the sub door 50, but is not limited thereto.

According to the shape of the door, the panel assembly 60 is configured such that an opening is formed in the door 20 and the panel assembly may be mounted to shield the opening of the door 20 even when the panel assembly 60 is configured as a single door like the door 20 on the right side of the refrigerating chamber 12.

In other words, it should be noted that the panel assembly 60 can be applied to any type of door in which an opening passing through the door is formed, regardless of the shape of the refrigerator and the shape of the door.

The sub door 50 is provided with a sub-upper hinge 501 and a sub lower hinge 502 at the upper end and the lower end, respectively and may be rotatably mounted on the front surface of the main door 40.

The sub door 50 may be provided with an opening device 59. The main door 40 may be provided with a locking unit 42 at a position corresponding to the opening device 59. Accordingly, the sub door 50 may maintain a closed state by the combination of the opening device 59 and the locking unit 42. When the coupling between the opening device 59 and the locking unit 42 is released by the manipulation of the opening device 59, the sub door 50 may be opened based on the main door 40.

A damping device 504 may be provided at a lower end of the sub door 50. The damping device 504 is configured to mitigate an impact when the sub door 50 is closed.

The damping device 504 may be located in a portion adjacent to the sub lower hinge 502 so as to alleviate an impact when the heavy sub door 50 is closed by the panel assembly 60.

Meanwhile, a storage case 43 may be provided on the rear surface of the main door 40. A plurality of door baskets 431 may be disposed in the storage case 43. The storage case 43 may include a case door 432 to cover the rear surface of the door basket 431.

Figure 4:
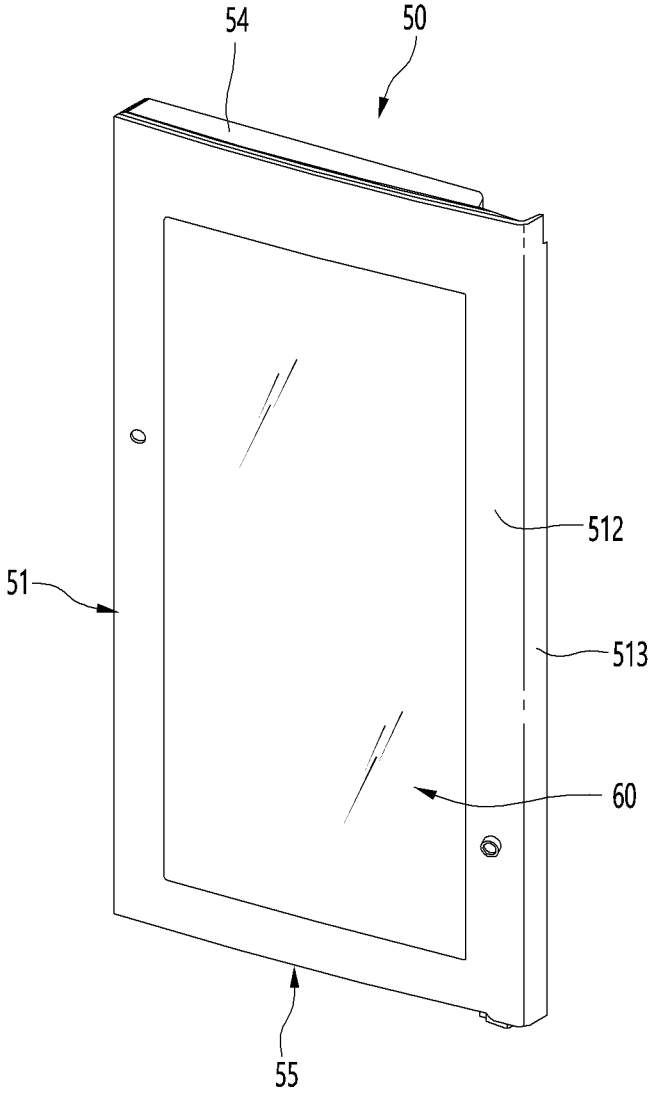
FIG. 4 is a perspective view illustrating a state where the sub door is viewed from the front.
Figure 5:
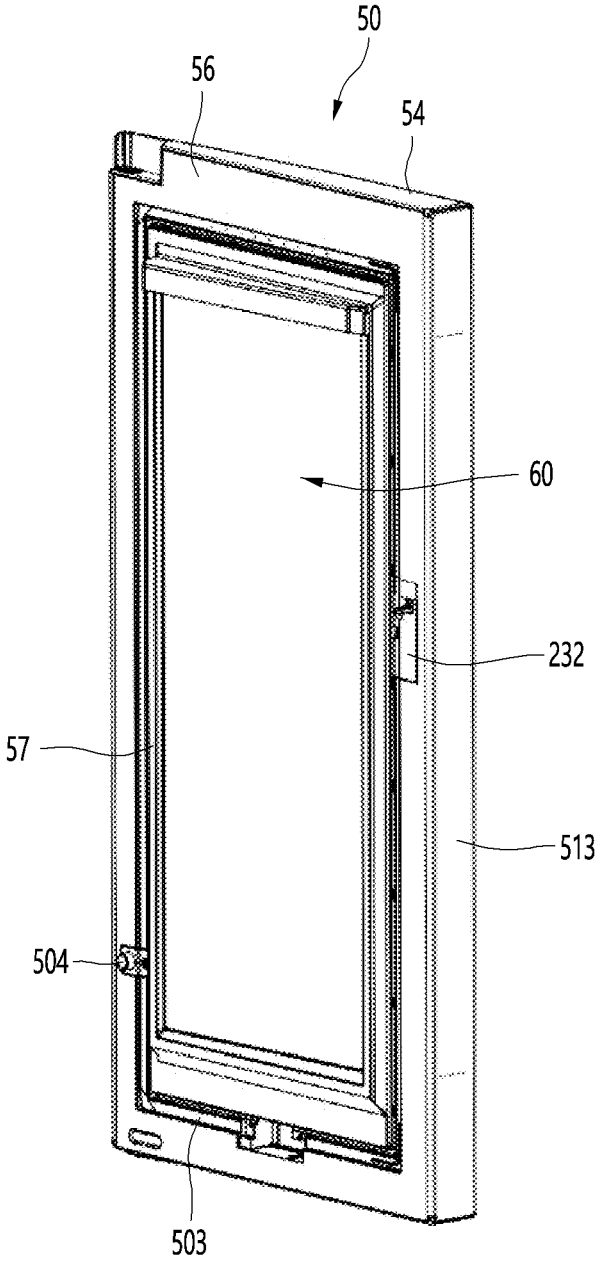
FIG. 5 is a perspective view illustrating a state where the sub door is viewed from the rear.
Figure 6:
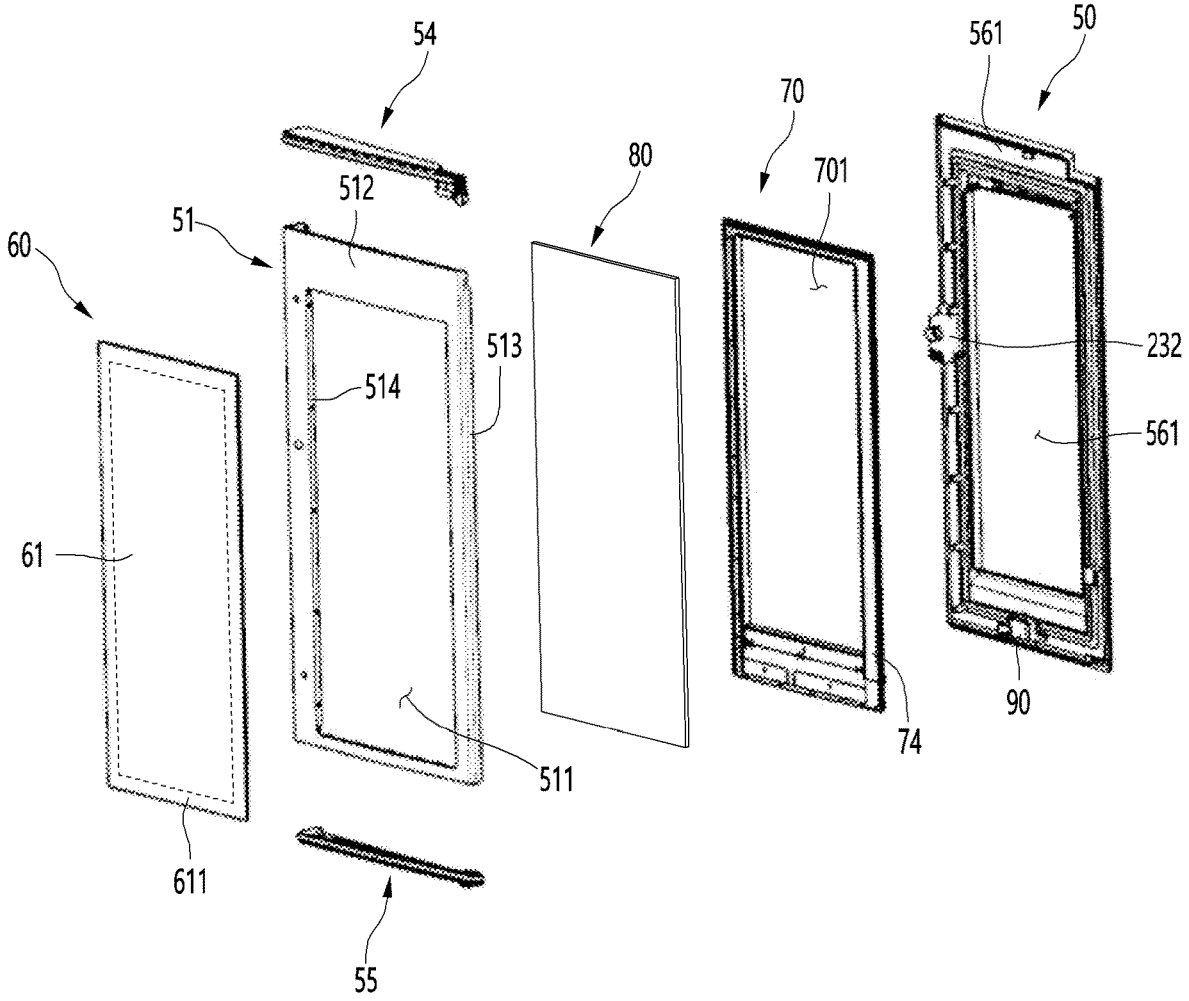
FIG. 6 is an exploded perspective view illustrating a state where the sub door is viewed from the front.
Figure 7:
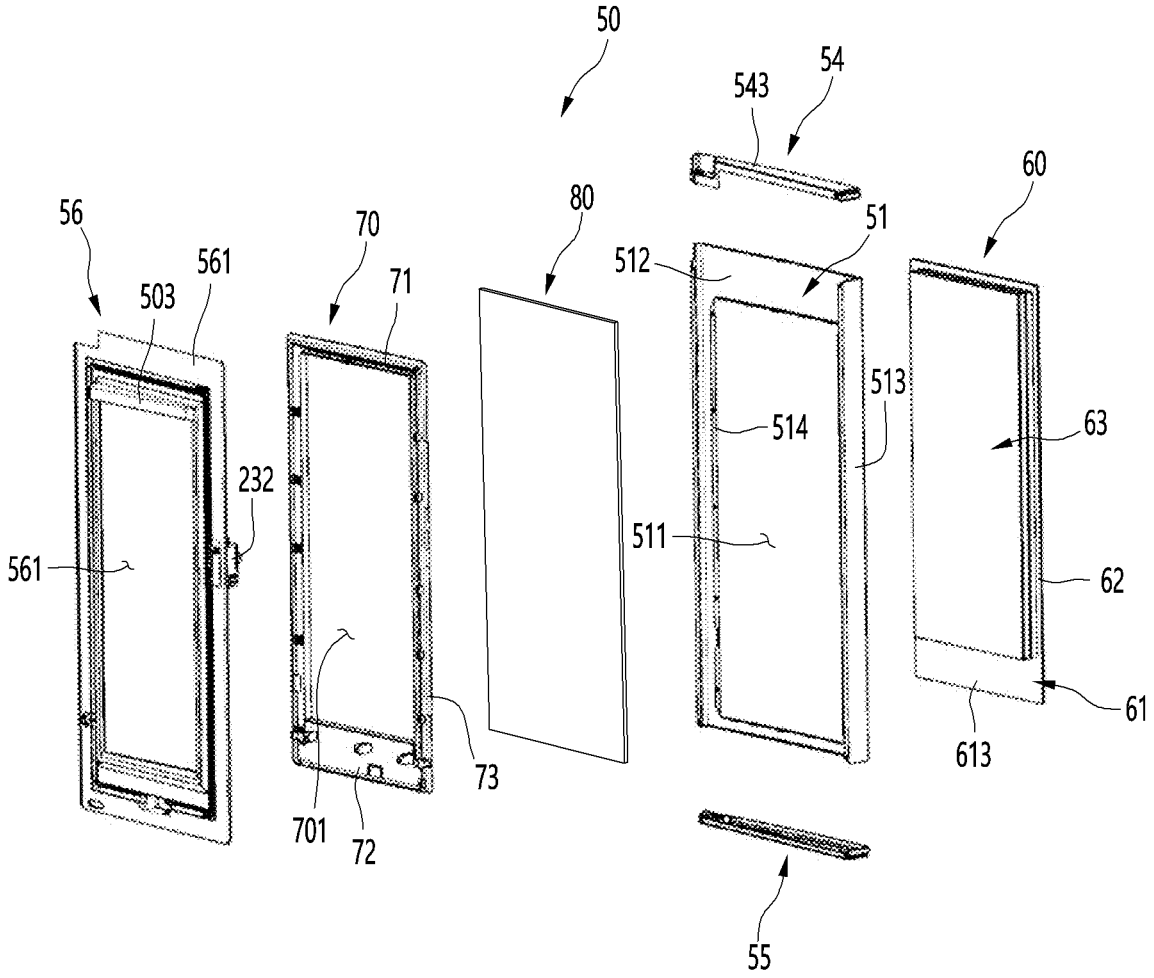
FIG. 7 is an exploded perspective view illustrating a state where the sub door is viewed from the rear.

FIG. 4 is a perspective view illustrating a state where the sub door is viewed from the front, FIG. 5 is a perspective view illustrating a state where the sub door is viewed from the rear, FIG. 6 is an exploded perspective view illustrating a state where the sub door is viewed from the front, and FIG. 7 is an exploded perspective view illustrating a state where the sub door is viewed from the rear.

The sub door 50 includes an outer plate 51 forming an outer appearance and a door liner 56 spaced apart from the outer plate 51 to form a rear surface.

The sub door 50 includes an outer plate 51 and a panel assembly 60 mounted to the opening of the door liner 56.

The sub door 50 may include an upper cap decoration 54 forming an upper surface and a lower cap decoration 55 forming a lower surface. The sub door 50 may be formed by combining the outer plate 51, the door liner 56, the panel assembly 60, the upper cap decoration 54, and the lower cap decoration 55.

The outer plate 51 may form a portion of a front outer appearance and a circumferential surface of the sub door 50. The outer plate 51 may be formed of a plate-shaped stainless material.

The outer plate 51 may be formed of the same material as the front surfaces of the refrigerating chamber door 20 and the freezing chamber door 30.

The outer plate 51 may include a front portion 512 that forms the outer appearance of the front surface and a side portion 513 that forms the outer appearance of the side. A plate opening 511 is formed in the center of the front portion 512, and the plate opening 511 may be formed to be shielded by the panel assembly 60. Since the inside of the refrigerator can be viewed through the panel assembly 60 that shields the plate opening 511, the inside of the plate opening 511 may be referred to as the see-through portion 21.

A plate bent portion 514 bent backward may be formed on a circumferential surface of the outer plate opening 511. The plate bent portion 514 may be formed along the circumference of the plate opening 511. The plate bent portion 514 may extend by a predetermined length to be inserted into and fixed to the support frame 70.

At both ends of the front portion 512 of the outer plate 51, side portions 513 bent backward may be formed. The side portion 513 may be bent inwardly to be coupled to the door liner 56.

The upper end and the lower end of the front portion 512 may be respectively bent inwardly to be coupled to the upper cap decoration 54 and the lower cap decoration 55.

The door liner 56 may form a rear surface of the sub door 50. The door liner 56 has a liner opening 561 formed in the region where the panel assembly 60 is disposed.

A sub gasket 503 for sealing the space between the sub door 50 and the main door 40 may be mounted on the rear surface of the door liner 56.

A locking unit 42 may be mounted on one side of the door liner 58, and a knock detection device 90 and a door opening auxiliary device 59 may be mounted thereon.

The knock detection device 90 is a device for detecting a knock manipulation of the sub door 50 by a user. The knock detection device 90 may include a microphone module that detects a knock-on signal by sensing a sound wave.

Door lights may be provided on both sides of the liner opening 561. The door lights may be provided to illuminate the rear surface of the sub door 50 and the rear of the panel assembly 60.

The inner space of the storage case 43 can be illuminated by the door light. When the door light is turned on, the inside of the storage case 43 becomes brighter, so that the inside of the refrigerator is brighter than the outside of the refrigerator. Accordingly, it is possible to visualize the space behind the sub door 50 through the panel assembly 60.

For example, the door lights may be disposed in a direction facing each other on both sides of the panel assembly 60. The mounting position of the door light may be variously arranged if the door light can have sufficient brightness at the rear of the sub door 50.

The upper cap decoration 54 forms the upper surface of the sub door 50 and is coupled to the outer plate 51 and the upper end of the door liner 56.

The upper surface of the upper cap decoration 54 is opened, and a decoration opening communicating with the space above the panel assembly 60 is formed and may be shielded by the decoration cover. PCBs for operation of electric components inside the panel assembly 60 and the sub door 50 may be mounted on the decoration cover 543.

The lower cap decoration 55 forms the lower surface of the sub door 50 and is coupled to the outer plate 51 and the lower end of the door liner 56.

The panel assembly 60 may be disposed between the outer plate 51 and the door liner 56. The panel assembly 60 may be configured to shield the plate opening 511 and the door liner opening 561.

The panel assembly 60 may be selectively manipulated by a user into any one of transparent, semi-transparent, opaque, and screen output states.

Accordingly, the user can selectively see through the inner space of the sub door 50 through the panel assembly 60 and also view the screen output through the panel assembly 60.

Meanwhile, the panel assembly 60 may not include a display for screen output. The panel assembly 60 without a display may have the same outer appearance structure as the panel assembly 60 with a display except that a screen is not output.

A support frame 70 for supporting the panel assembly 60 is mounted around the plate opening 511 of the outer plate 51.

The panel assembly 60 may be fixedly mounted to the outer plate 51 by the support frame 70.

The support frame 70 has a frame opening 701 formed in the center thereof. The frame opening 701 is formed smaller than the size of the plate opening 511 to provide a structure in which the panel assembly 60 can be seated.

When the panel assembly 60 is mounted, the rear panel 65 may pass sequentially through the plate opening 511 and the frame opening 701 to be seated on the door liner 56.

The support frame 70 has a structure coupled to the outer plate 51, and the outer plate 51 and the end portion of the panel assembly 60 may be mounted in close contact with each other.

The support frame 70 has a fixed structure of the heater 80. The heater 80 may be disposed on the rear surface of the panel assembly 60 while being fixedly mounted to the support frame 70.

In this case, the heater 80 may be disposed on the bezel 611 formed around the front panel 61, so that the structures of the heater 80 and the support frame 70 are not exposed to the outside.

Hereinafter, the panel assembly structure will be described in more detail.

The panel assembly 60 includes a front panel 61 forming a front surface, a rear panel 63 forming a rear surface, and an adiabatic panel 62 disposed between the front panel 61 and the rear panel 63.

The panel assembly 60 may include the front panel 61, the adiabatic panel 62, and the interstitial rod 64 supporting between the plurality of adiabatic panels 62.

The front panel 61 may be formed of a glass material capable of selectively passing through the interior according to light transmittance and reflectance and may be referred to as a half mirror.

In other words, in a state where the door lighting unit is turned on, as the light inside the refrigerator passes through the front panel 61, the front panel 61 becomes transparent. Accordingly, the space inside the refrigerator behind the sub door 50 or the storage space formed in the main door 40 can be viewed from the outside when the sub door 50 is closed.

In addition, when the door lighting unit 57 is turned off, light does not pass through the front panel 61 but is reflected, and thus the front panel 61 becomes like a mirror surface. In such a state, the space inside refrigerator behind the sub door 50 or the storage space formed in the main door 40 cannot be seen from the outside.

Various surface treatments may be applied to the front panel 61 so that the front panel 61 may have a half-mirror-like effect. For example, a titanium compound may be vacuum-deposited on the entire surface of the glass layer constituting the front panel 61.

When a ceramic printed layer or a hard coating layer is formed on the rear surface of the glass layer, the front panel 61 may be formed so that light transmittance from the outside of the front panel 61 is 20% to 30%. At this time, when the transmittance is equal to or less than 20%, it may not be easy to see the inside even when the door lighting unit 57 is turned on when viewed from the outside.

When the transmittance is 30% or more, even when the door lighting unit 57 is turned off, the front surface of the panel assembly 60 is not visible like a mirror surface when viewed from the outside, and the inside of the refrigerator can be partially seen through.

Meanwhile, the bezel 611 formed along the circumference of the rear surface of the front panel 61 may be formed so that light cannot pass through, and the edge of the front panel 61 on which the bezel 611 is formed is configured to extend further outward than the adiabatic panel 62.

Accordingly, on the rear surface of the front panel 61 on which the bezel 611 is formed, the support frame 70, the heater 80, and the interstitial rod 64 are not exposed forwardly through the front panel 61.

In addition, the knock detection device 90 may be disposed on the bezel 611 formed on the front panel 61. Accordingly, the knock detection device 90 may also be covered by the bezel 611 so as not to be exposed to the outside.

In detail, the support frame 70 may be disposed in the area of the bezel 611 to fix the panel assembly 60. In addition, the heater 80 fixed by the support frame 70 may also be located in the region of the bezel 611.

Accordingly, both the heater 80 and the support frame 70 disposed along the edge of the panel assembly 60 are covered by the bezel 611 so that they are not exposed to the outside.

An interstitial rod 64 is formed around the rear surface of the front panel 61. The interstitial rod 64 separates the front panel 61 and the adiabatic panel 62 from each other and allows the front panel 61 and the adiabatic panel 62 to be spaced apart from each other and seals the space therebetween.

The interstitial rod 64 may also be disposed between the plurality of adiabatic panels 62. The front panel 61, the adiabatic panel 62, and the plurality of interstitial rods 64 may be attached to each other by an adhesive.

In addition, the sealant may be applied to maintain an airtight state between the front panel 61, the adiabatic panel 62, and the interstitial rod 64; and the outer surface of the panel assembly 60.

The adiabatic panel 62 may be formed to be smaller in size than the front panel 61 and may be located in an inner region of the front panel 61. In addition, the adiabatic panel 62 is preferably chemically strengthened glass by immersing glass in an electrolyte solution at the glass transition temperature or more to be chemically strengthened.

The sealed space between the front panel 61 and the adiabatic panel 62 formed by the interstitial rod 64 and the sealed space between the plurality of adiabatic panels may be formed in a vacuum state to have adiabatic properties.

The adiabatic panel 62 may be formed as a single panel and mounted to be spaced apart from the front panel 61, and if necessary, two or more adiabatic panels 62 may be configured to be spaced apart.

The panel assembly 60 may be configured such that, if necessary, a display and a light guide plate are disposed behind the front panel 61 to output a screen on the front surface of the panel assembly 60.

The display may be configured as an LCD module on which a screen is output and may be configured to be transparent in a state where the screen is not outputted to be transparent.

The light guide plate may be spaced apart from the rear of the display by a predetermined distance. The light guide plate is for diffusion or scattering of light irradiated from the display light and may be formed of various materials. For example, the light guide plate may be formed of a polymer material, and a pattern may be formed on the surface thereof or may be formed by attaching a film.

Meanwhile, according to an embodiment of the present disclosure, a heater 80 for preventing dew condensation from being generated in the panel assembly 60 may be provided. The heater 80 may be disposed to be in contact with the rear surface of the panel assembly 60 while being fixedly mounted to the support frame 70.

Hereinafter, the support frame 70 will be described in detail.

Figure 8:
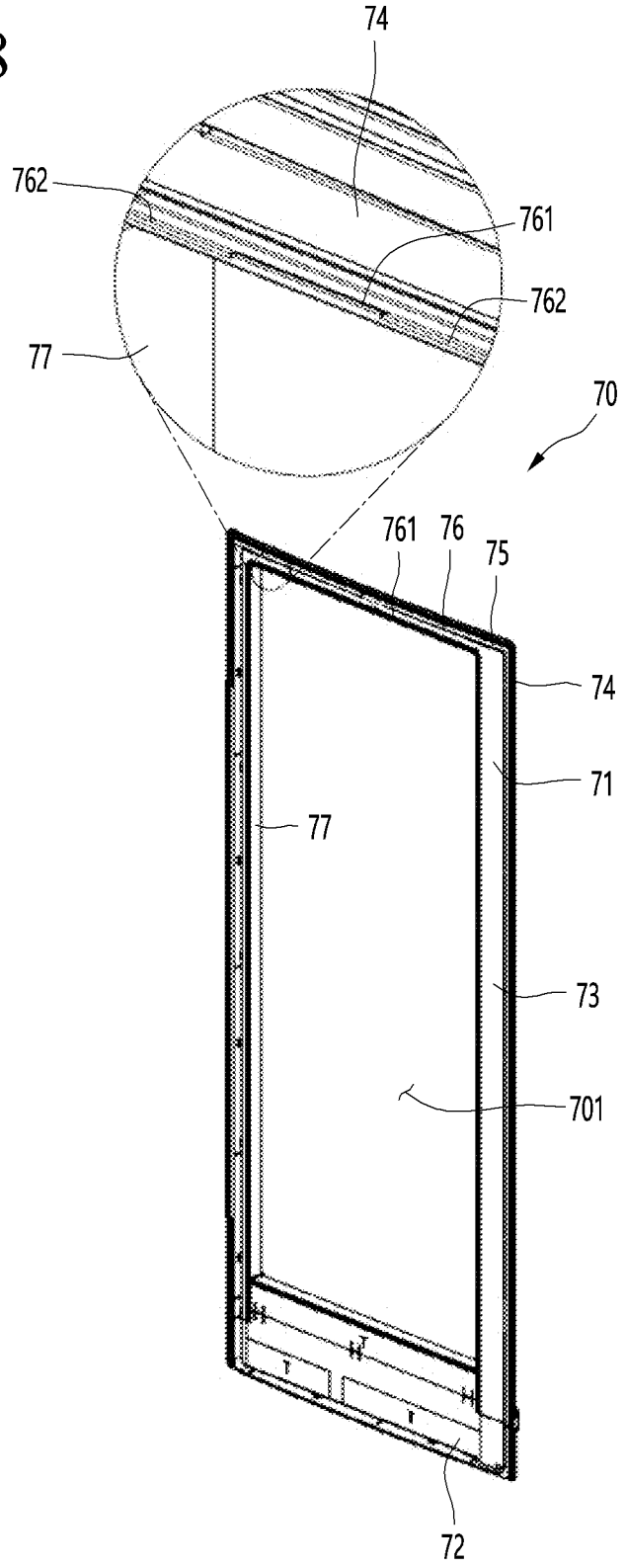
FIG. 8 is a perspective view illustrating a state where a support frame according to an embodiment of the present disclosure is viewed from the front.
Figure 9:
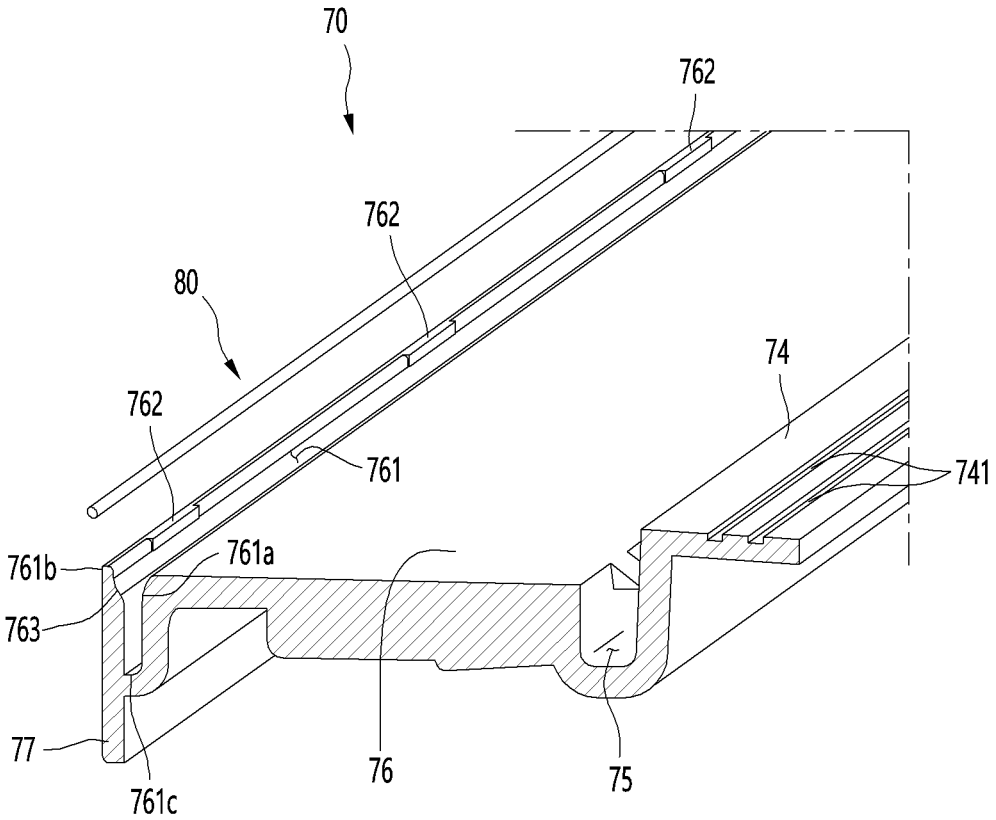
FIG. 9 is a cross-sectional perspective view illustrating the support frame for explaining the fixing structure of the heater according to an embodiment of the present disclosure.
Figure 10:
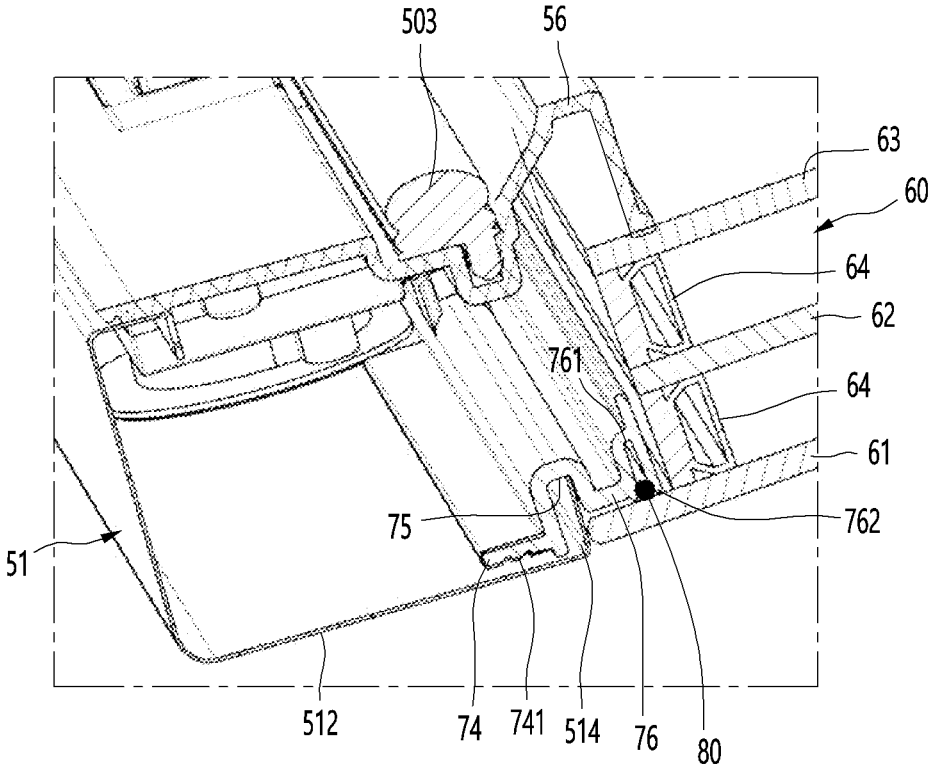
FIG. 10 is a cross-sectional perspective view illustrating a structure in which the heater is mounted on a support frame.
Figure 11:
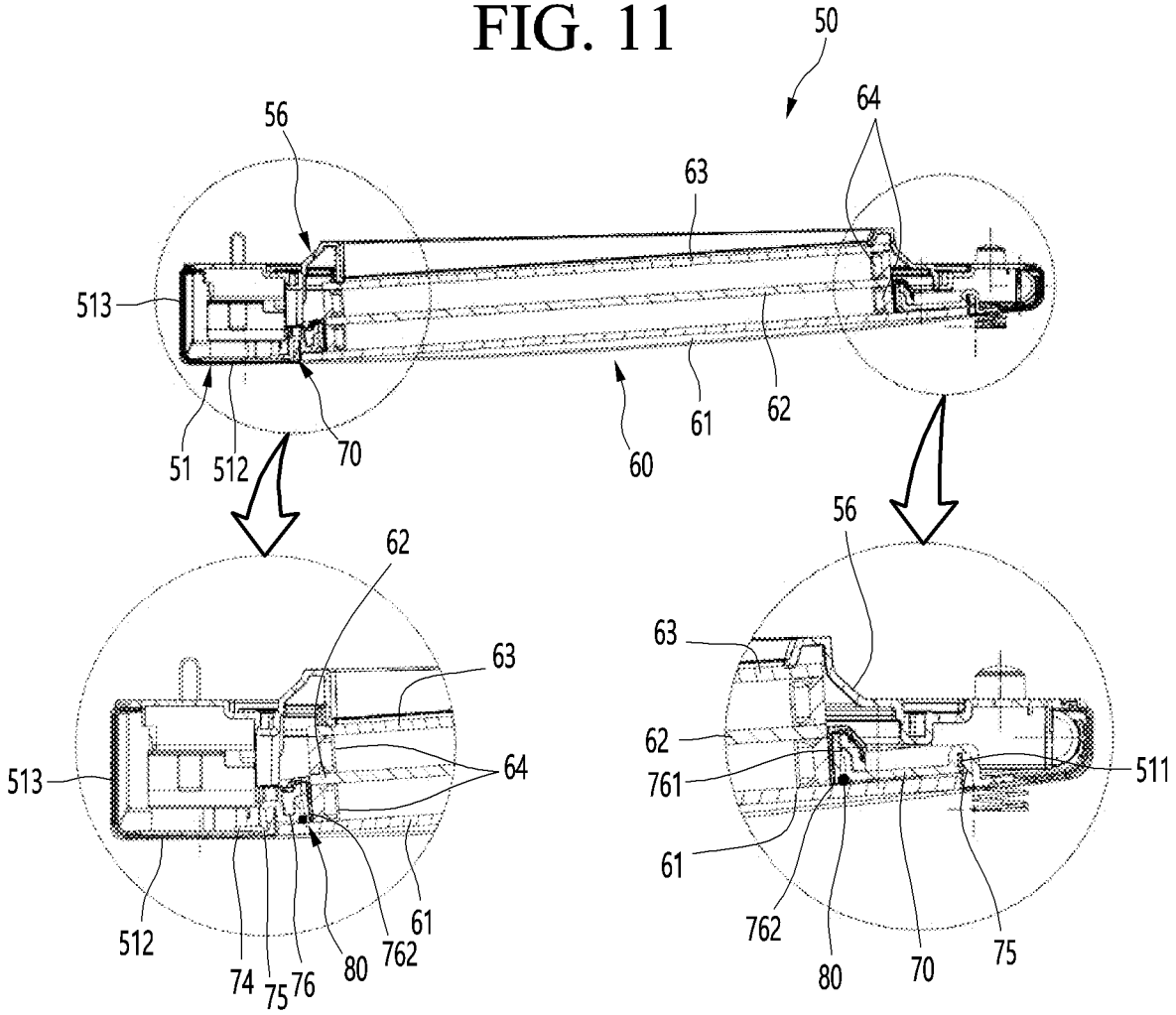
FIG. 11 is a cross-sectional view illustrating the sub door.

FIG. 8 is a perspective view illustrating a state where a support frame according to an embodiment of the present disclosure is viewed from the front, FIG. 9 is a cross-sectional perspective view illustrating the support frame for explaining the fixing structure of the heater according to an embodiment of the present disclosure, FIG. 10 is a cross-sectional perspective view illustrating a structure in which the heater is mounted on a support frame, and FIG. 11 is a cross-sectional view illustrating the sub door.

The support frame 70 is formed in a rectangular frame shape, and the frame opening 701 is formed in the center thereof. In addition, the support frame 70 is formed to have a predetermined width to fix the outer plate 51 and is configured to support the panel assembly 60 at the same time.

The support frame 70 may include an upper frame 71 forming an upper portion, a lower frame 72 forming a lower portion, and a side frame 73 connecting between both ends of the upper frame 71 and the lower frame 72.

The support frame 70 may form the overall shape of the support frame 70 by combining the upper frame 71, the lower frame 72, and the side frame 73.

The upper frame 71 may form an upper portion of the support frame 70. The upper frame 71 may partition the upper space of the sub door 50 in the front and rear direction.

A frame barrier 561 extending up to the upper surface of the sub door 50 may be formed on the door liner 56, and the upper space of the sub door 50 may be partitioned by the frame barrier 561 in the front and rear direction. In addition, a space in which the PCBs can be accommodated may be provided at the rear.

The lower frame 72 may be coupled to the lower end of the side frame 9. The lower frame 72 may be configured to support a lower portion of the outer plate 51 and a lower end of the panel assembly 60.

The side frame 73 may form both sides of the support frame 70 in the left and right direction and may extend long in the vertical direction to connect between the upper frame 71 and the lower frame 72. The side frame 73 may have a structure capable of being coupled to both ends of the upper frame 71 and the lower frame 72.

Of course, in the support frame 70, the upper frame 71, the lower frame 72, and the side frames 73 may be integrally formed.

The support frame 70 may have a structure for supporting the outer plate 51 and the front panel 61.

The support frame 70 may include a plate support portion 74. The plate support portion 74 forms the outermost portion of the support frame 70 and may be formed so that the front surface can be in close contact with the rear surface of the outer plate 51.

In other words, the outermost circumference of the support frame 70 supports the rear surface of the outer plate 51 and may be adhered to the rear surface of the outer plate 51 by an adhesive member such as a double-sided tape or an adhesive.

The plate support portion 74 may be formed along the circumference of the support frame 70. The plate support portion 74 may be formed on all the upper frame 71, the lower frame 72, and the side frame 73.

The plate support portion 74 may include a concave-convex portion 741. The concave-convex portion 741 allows the sealant to be uniformly applied, so that the outer plate 51 and the support frame 70 can be firmly adhered.

The support frame 70 may include a plate accommodation groove 75. The plate accommodation groove 75 may be recessed at an end portion of the plate support portion 74. The plate accommodation groove 75 may be formed so that the plate bent portion 514 of the outer plate 51 is inserted.

In a state where the outer plate 51 is adhered to the support frame 70, the plate bent portion 514 may be in a state of being inserted into the plate accommodation groove 75.

The plate bent portion 514 may be in contact with the circumferential end portion of the panel assembly 60 while being inserted into the plate accommodation groove 75. Accordingly, when viewed from the front, the plate bent portion 514 may be in close contact with a portion between the outer plate 51 and the front surface of the panel assembly 60 without a gap.

The support frame 70 may have a panel support portion 76 formed at an inner portion of the plate accommodation groove 75.

The panel support portion 76 is for supporting the rear surface of the front panel 61 and may be positioned at a rear of the plate support portion 74 so as to be stepped with the plate support portion 74.

A guide rib 751 may be formed inside the plate accommodation groove 75. The guide rib 751 allows the plate bent portion 514 inserted into the plate accommodation groove 75 to be in close contact with the transparent panel assembly 60.

The guide rib 751 guides so as to maintain an accurate position while being inserted into the inner side of the plate accommodation groove 75.

A blocking portion 77 bent in a vertical direction may be formed at an end portion of the panel support portion 76. The blocking portion 77 may block the inflow of the foaming liquid for molding the adiabatic material 531 toward the transparent panel assembly 60.

Meanwhile, a heater accommodation groove 761 may be formed in the panel support portion 76. The heater 80 may be accommodated inside the heater accommodation groove 761. The heater 80 may heat the rear surface of the front panel 61.

In detail, the heater accommodation groove 761 is for heating the circumference of the transparent panel assembly 60 in contact with the panel support portion 76 to prevent dew condensation and may be formed along the panel support portion 76.

The heater 80 is used to heat the circumference of the front panel 61, which has poor adiabatic properties, and prevents dew condensation from being generated around the front panel 61.

The heater 59 may be disposed along the circumference of the rear surface of the panel assembly 60.

A location where the heater 80 is installed may be located on a vertical line of the gasket 503 inside the bezel 611 region.

The distance region between the door liner 56 and the front panel 61 is relatively weak in adiabatic properties. Accordingly, by disposing the heater 80 at the corresponding position, dew condensation is prevented from being generated on the front surface of the front panel 61.

In addition, the circumferential portion of the front panel 61, that is, the front protrusion 613 is present between the region filled with the heat insulating material 513 inside the sub door 50 and the adiabatic layer formed on the panel assembly 60 and thus becomes a portion that does not have substantially adiabatic properties.

Accordingly, the circumferential portion of the front panel 61 may be vulnerable to adiabatic properties, and the region may be heated through the heater 80 to prevent dew condensation from being generated around the front panel 61.

By heating the end portion of the front panel 61 by the operation of the heater 80, the cold air is transmitted to the front panel 61 by the outer plate 51, and thus being capable of preventing dew condensation from being generated at the end portion of the front panel 61.

The heater is positioned on the bezel 611 so that it is possible to effectively prevent dew condensation by heating a portion vulnerable to adiabatic properties without being exposed to the outside.

The heater accommodation groove 761 may be formed in a shape corresponding to the heater 80.

The heater accommodation groove 761 completely accommodates the heater 80 so that the rear surface of the front panel 61 can be seated on the panel support portion 76 when the front panel 61 is mounted. In this case, the heater accommodation groove 761 may be formed so that the heater 80 is in contact with the rear surface of the front panel 61.

In detail, when the panel assembly 60 is mounted, a circumferential region of the front panel 61 may be seated in contact with the panel support portion 76. In addition, the heater mounted in the heater accommodation groove 761 may be located in a position adjacent to the interstitial rod 64. Accordingly, the circumferential region of the front panel 61 can be heated.

In this case, the location of the heater 80 is preferably disposed in the bezel 611 region of the front panel 61. Accordingly, when the transparent panel assembly 60 is mounted, the heater 80 in contact with the front panel 61 is not exposed to the outside.

The heater 80 may be formed in a wire shape and a generally used sheath heater may be used. The heater 80 has a diameter that can be inserted into the heater accommodation groove 761 and may be disposed along the circumference of the frame opening 701.

Meanwhile, the support frame 70 may be provided with a heater restraint portion 762 for restraining the heater 80. The heater restraint portion 762 may fix the heater 80 in a state where the heater 80 is inserted into the heater accommodation groove 761.

A plurality of heater restraint portions 762 may be arranged along the heater accommodation groove 761. The heater restraint portion 762 may be formed to contact at least a portion of the heater 80. Therefore. It is possible to prevent the heater 80 from flowing while being inserted into the heater accommodation groove 761.

The heater restraint portion 762 may be provided at an end portion extending in one direction from the heater accommodation groove 761.

In detail, the heater accommodation groove 761 may be provided at one end of the panel support portion 76. For example, the support frame 70 may have a heater accommodation groove 761 on one side and a plate accommodation groove 75 on the other side thereof with respect to the panel support portion 76.

The heater accommodation groove 761 may be formed by recessing one side end of the panel support portion 76 in one direction.

In detail, the heater accommodation groove 761 may include a first portion 761*a* formed at one end of the panel support portion 76, a second portion 761*b* provided to be spaced apart from the first portion 761*a* in one direction, and a third portion 761*c* connecting the first portion 761*a* and the second portion 761*b*.

The third portion 761*c* may be formed by being recessed in the rear direction with respect to the first portion 761*a* or the second portion 761*b*.

When the heater 80 is mounted in the heater accommodation groove 761, the heater 80 may be disposed to be spaced apart from the third portion 761*c* by a set interval.

For example, the third portion 761*c* may be formed to be spaced apart so that a distance from the front end of the panel support portion 76 is two or more times, preferably three times or more, the diameter of the heater 80.

The third portion 761*c* may be formed such that a distance spaced apart from the front end of the panel support portion 76 corresponds to a distance at which the plate accommodation groove 75 is recessed from the front end of the panel support portion 76.

In this case, in a state where the heater 80 is mounted in the heater accommodation groove 761, the heat of the heater 80 may be effectively transferred to the front panel 61. When the heater 80 is disposed adjacent to the third portion 761*c*, heat generated by the heater 80 may be transferred to the third portion 761*c*.

In other words, heat generated by the heater 80 may be distributed to the front panel 61 and the third portion 761*c*. Therefore, in order for the heat of the heater 80 to be effectively transferred to the front panel 61, the heater 80 and the third portion 761*c* are preferably disposed to be spaced apart from each other by a set interval.

The heater restraint portion 762 may be formed in the second portion 761*b*. In other words, the heater restraint portion 762 may be formed at an end portion in a direction away from the plate support portion 74 with respect to the heater accommodation groove 761.

The heater restraint portion 762 may be configured to be in contact with at least a portion of the heater 80. For example, the heater restraint portion 762 may be formed to extend from the second portion 761*b* to the first portion 761*a*. In this case, the heater restraint portion 762 may press at least a portion of the heater 80.

The first portion 761*a* and the second portion 761*b* may be formed of a material having elasticity. Accordingly, the heater 80 can be easily inserted into the heater accommodation groove 761 by elastic deformation of the second portion 761*b*. In addition, when the heater 80 is inserted into the heater accommodation groove 761, the heater restraint portion 762 presses the heater 80 to prevent the heater 80 from moving.

The end portion of the second portion 761*b* may be formed more forward than the front end of the panel support portion 76. In other words, when the support frame 70 is viewed from the front, the second portion 761*b* may be formed to protrude more forward than the front surface of the panel support portion 76.

The heater restraint portion 762 may be formed to protrude from the second portion 761*b* toward the first portion 761*a*. In this case, the lower end of the heater restraint portion 762 may be formed at a position corresponding to the front end of the plate support portion 74.

A round groove 763 may be provided in the second portion 761*b*. The round groove 763 may be formed by being recessed to be rounded in one direction in the second portion 761*b*. The lower end of the round groove 763 may be formed at a position corresponding to the front end of the panel support portion 76.

Due to the round groove 763, it is possible to prevent the second portion 761*b* from being damaged in a process of inserting the heater 80 into the heater accommodation groove 761. At least one surface of the heater 80 may be in contact with the round groove 763.

As the heater 80 is disposed in contact with the round groove 763, the heater 80 may be more firmly mounted.

The heater 80 may be fixedly mounted to the heater accommodation groove 761 by the heater restraint portion 762. Accordingly, the operation of attaching a tape or the like to fix the heater 80 to the heater accommodation groove 761 may be omitted. The operation of mounting the heater 80 to the support frame 70 may be simplified by the heater restraint portion 762.

In addition, the heater 80 may be adjusted to be in contact with the area set on the front panel 61 by the heater restraint portion 762.

Figure 12:
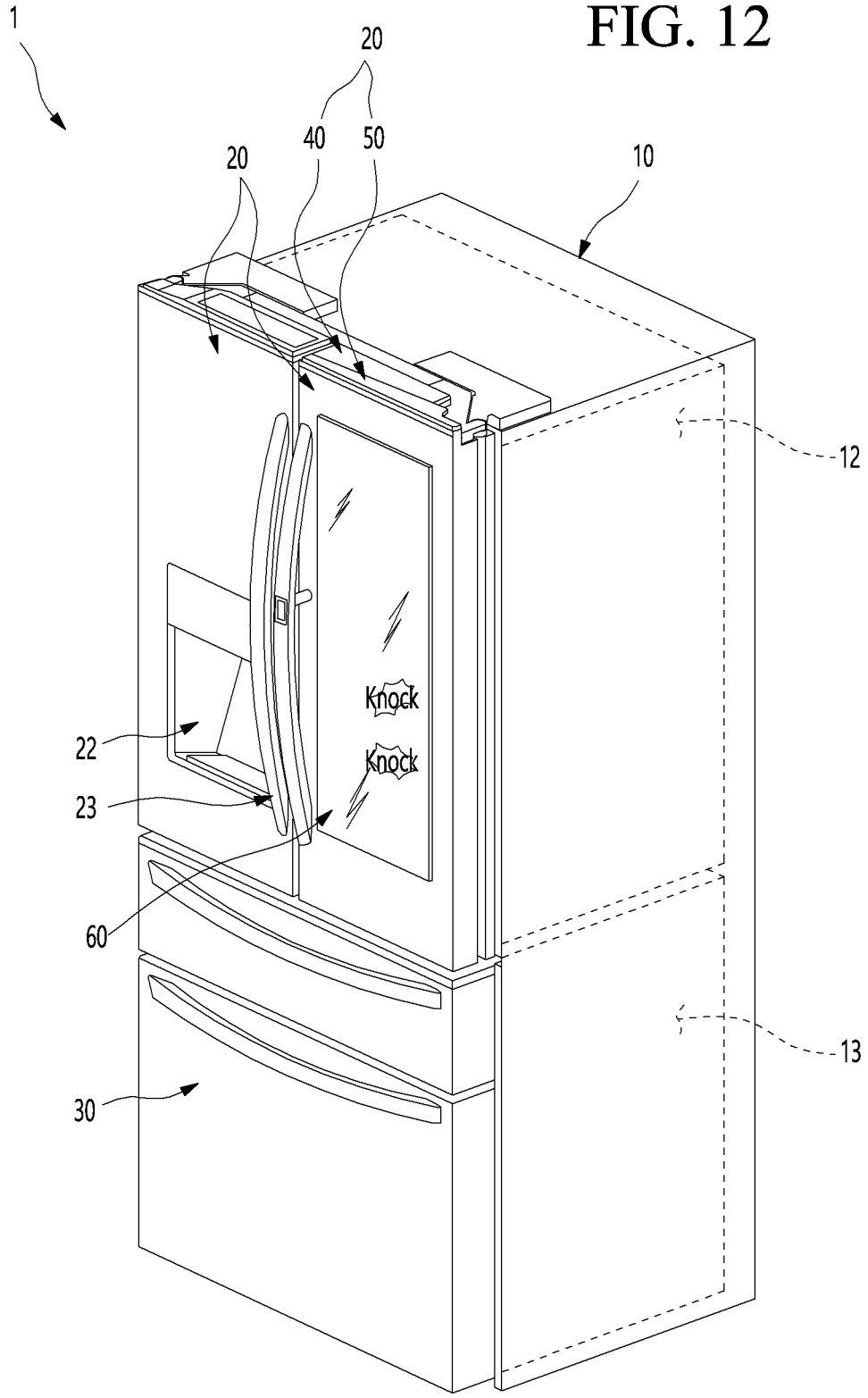
FIG. 12 is a perspective view illustrating a state of the refrigerator before a knock manipulation.
Figure 13:
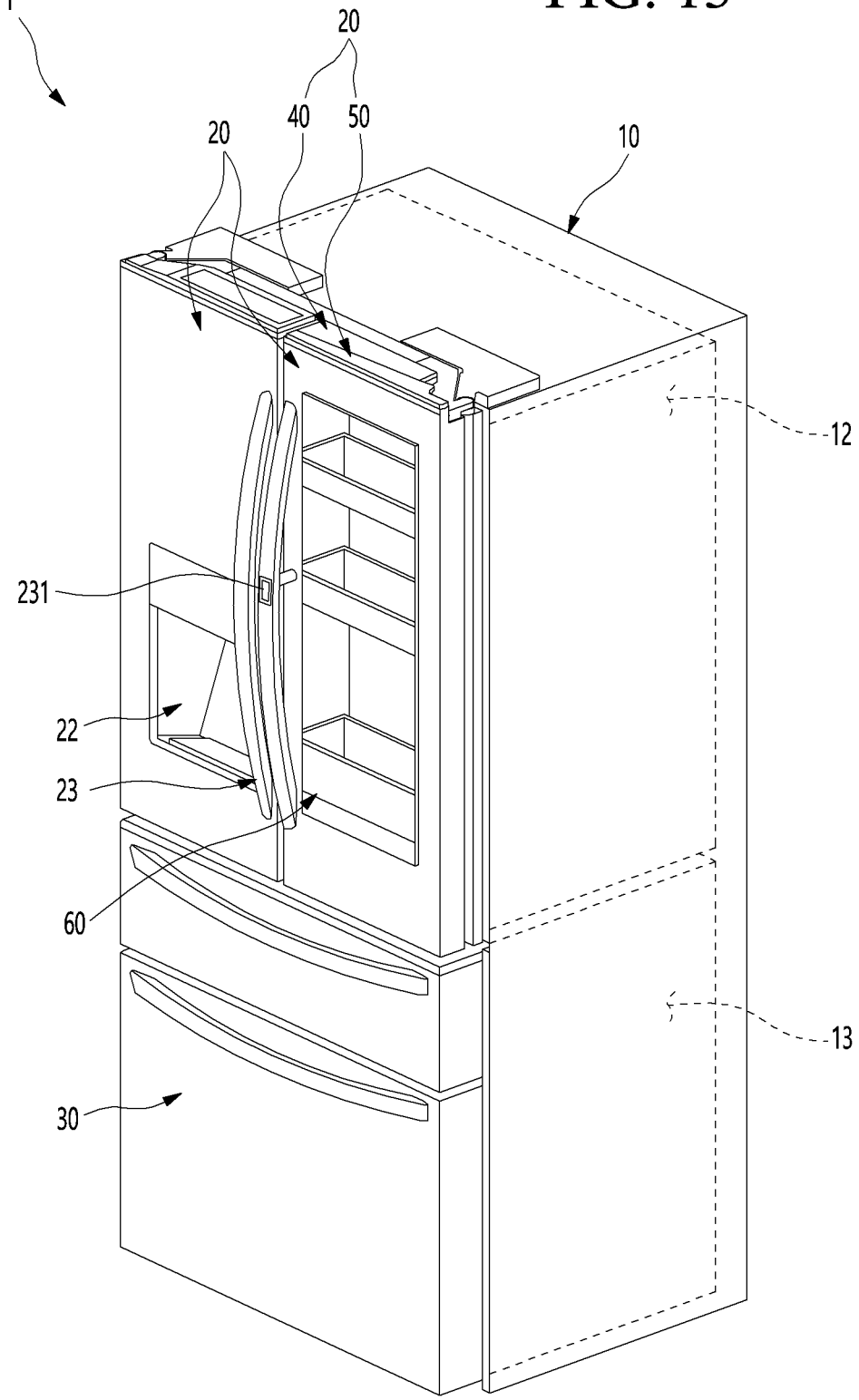
FIG. 13 is a perspective view illustrating a state of the refrigerator after a knock manipulation.

FIG. 12 is a perspective view illustrating a state of the refrigerator before a knock manipulation, and FIG. 13 is a perspective view illustrating a state of the refrigerator after a knock manipulation.

The refrigerator 1 may be in a mirror-like state as the panel assembly 60 is in an opaque state as illustrated in FIG. 12 in a general situation without a separate manipulation. In such a state, it becomes impossible to see through the inside of the refrigerator.

In addition, in this state, the knock detection device 90 maintains a state where a user's manipulation input is possible at any time in an activated state.

In such a state, if the user performs a knock-on manipulation to knock on the front of the sub door 50, that is, the front panel 61, from the front of the refrigerator to check the state of food storage in the refrigerator, the knock detection device detect the knock-on manipulation and the detection device PCB determines whether the knock-on manipulation is a valid manipulation.

When a valid knock-on signal is detected, the controller 14 turns on the door lighting unit 57.

When the door lighting unit 57 is turned on, the inside of the see-through portion 21 is brightened, and the light inside the refrigerator passes through the panel assembly 60. In particular, as the light passes through the front panel 61, the front panel 61 becomes transparent, so that the inside can be seen through as illustrated in FIG. 13.

When the sub door 50 becomes transparent, the user can check the storage space or the space inside the refrigerator in the main door 40, and open the sub door 50 to accommodate food or perform a necessary operation.

When a set time elapses or a valid knock-on signal is input after the door lighting unit 57 is turned on, the door lighting unit 57 may be turned off.

When the door lighting unit 57 is turned off, the inside of the refrigerator becomes dark, and the outside of the refrigerator becomes bright. In this state, the light outside the refrigerator is reflected from the front panel 61, so that the front surface of the sub door 50 is in a mirror-like state, making it impossible to see through the inside of the refrigerator. Accordingly, the sub door 50 maintains an opaque state until a new manipulation is input.

What is claimed is:

1. A refrigerator comprising:
a cabinet forming a storage space; and
a door configured to open and close the storage space;
wherein the door includes:
an outer plate forming a front surface of the door and having an opening;
a panel assembly mounted to the opening;
a heater configured to heat the panel assembly;
a door liner forming a rear surface of the door; and
a support frame configured to support a rear surface of the panel assembly;
wherein the panel assembly includes:
a front panel forming a front surface;
an adiabatic panel disposed at the rear spaced apart from the front panel;
a rear panel forming a rear surface; and
an interstitial rod disposed between the front panel and the adiabatic panel, and
wherein the support frame includes:
a panel support portion formed along the circumference of the front panel;
a heater accommodation groove recessed from a front surface to a rear surface of the panel support portion to accommodate the heater, and including a pair of portions spaced so as to face each other and forming an upper end of the heater accommodation groove; and
a heater restraint portion protruding from one of the pair of portions toward the other of the pair of portions and configured to restrain the heater.

2. The refrigerator of claim 1,
wherein the front panel is formed larger than the adiabatic panel or the rear panel, and
wherein the heater accommodation groove is formed along a circumference of the front panel.

3. The refrigerator of claim 2,
wherein a plurality of the heater restraint portions are arranged along the heater accommodation groove.

4. The refrigerator of claim 1,
wherein the pair of portions includes:
a first portion formed on one end of the panel support portion; and
a second portion spaced apart from the first portion in one direction,
wherein the heater accommodation groove further includes:
a third portion configured to connect a rear end of the first portion and a rear end of the second portion.

5. The refrigerator of claim 4,
wherein the heater is disposed to be spaced apart from the third portion by a set interval.

6. The refrigerator of claim 4,
wherein the heater restraint portion is formed to protrude from the second portion toward the first portion.

7. The refrigerator of claim 5,
wherein the end portion of the second portion is formed to extend further forward than the front end of the panel support portion, and
wherein the heater accommodation groove includes a round groove formed by being recessed to be rounded from the second portion.

8. The refrigerator of claim 6,
wherein the heater is in contact with the round groove.

9. The refrigerator of claim 4,
wherein the outer plate includes a plate bent portion bent backward on a circumferential surface of the opening, and
wherein the support frame includes a plate accommodation groove formed at the other end of the panel support portion and formed so that the plate bent portion is inserted thereinto.

10. The refrigerator of claim 8,
where a length recessed from the front to the rear of the heater accommodation groove is formed to correspond to a length in which the plate accommodation groove is recessed from the front to the rear.

11. The refrigerator of claim 8,
wherein a length recessed from the front to the rear of the heater accommodation groove is formed to be twice or more the diameter of the heater.

12. The refrigerator of claim 1,
wherein the door includes a main door configured to open and close the storage space; and a sub door rotatably connected to the main door; and
wherein the sub door is formed by coupling the outer plate, the panel assembly, the door liner, and the support frame.

13. The refrigerator of claim 1,
wherein a bezel is formed along the circumference of the front panel, and
wherein the heater is disposed at a position corresponding to the bezel.

14. A refrigerator comprising:
a cabinet forming a storage space; and
a door configured to open and close the storage space;
wherein the door includes a main door configured to open and close the storage space; and a sub door rotatably connected to the main door;
wherein the sub door includes:
an outer plate forming a front surface of the door and having an opening;
a panel assembly mounted to the opening;
a heater configured to heat the panel assembly;
a door liner forming a rear surface of the door; and
a support frame configured to support a rear surface of the panel assembly; and
wherein the support frame includes:
a panel support portion formed along a circumference of the panel assembly;
a heater accommodation groove recessed from the front to the rear of the panel support portion to receive the heater and including a pair of portions spaced so as to face each other and forming an upper end of the heater accommodation groove; and a heater restraint portion configured to protrude from one of the pair of portions toward the other of the pair of portions and configured to restrain the heater.

15. The refrigerator of claim 14, wherein the panel assembly includes:

a front panel forming a front surface;

an adiabatic panel disposed at the rear spaced apart from the front panel;

a rear panel forming a rear surface; and an interstitial rod disposed between the front panel and the adiabatic panel, wherein the front panel is formed to be larger than the adiabatic panel and the rear panel, and wherein the heater is disposed along a circumference of a rear surface of the front panel.

* * * * *